United States Patent [19]

Kimber et al.

[11] 4,232,850

[45] Nov. 11, 1980

[54] DRILL BOOM ARRANGEMENT

[75] Inventors: Erich V. Kimber, Handen; Nils Hökby, Enskede, both of Sweden

[73] Assignee: Atlas Copco Aktiebolag, Nacka, Sweden

[21] Appl. No.: 28,891

[22] Filed: Apr. 10, 1979

[30] Foreign Application Priority Data

Apr. 11, 1978 [SE] Sweden ..... 7804054

[51] Int. Cl.[3] ..... F16M 1/00

[52] U.S. Cl. ..... 248/654; 173/43

[58] Field of Search ..... 248/654, 666, 647, 652, 248/651, 653; 182/2; 173/38, 43, 42, 28; 414/687, 694

[56] References Cited

U.S. PATENT DOCUMENTS

| | | | |
|---|---|---|---|
| 2,703,222 | 3/1955 | Feucht | 173/43 X |
| 2,993,685 | 7/1961 | Russell | 173/43 X |
| 3,302,731 | 2/1967 | Perry | 173/43 X |
| 3,304,033 | 2/1967 | Thompson | 248/654 |
| 3,322,378 | 5/1967 | Thompson | 173/43 X |
| 3,493,200 | 2/1970 | Huffman | 248/654 |
| 3,759,470 | 9/1973 | Kawano | 248/654 |
| 3,973,747 | 8/1976 | Jagerstrom | 173/43 X |
| 3,993,271 | 11/1976 | Kimber | 248/654 |

FOREIGN PATENT DOCUMENTS

| | | | |
|---|---|---|---|
| 2557048 | 7/1976 | Fed. Rep. of Germany | 173/43 |

*Primary Examiner*—J. Franklin Foss

*Attorney, Agent, or Firm*—Frishauf, Holtz, Goodman & Woodward

[57] ABSTRACT

A hydraulic drill boom arrangement for drifting and tunnelling comprises a boom proper (10) that is universally pivotably carried by a support plate (13) and carries a feed beam (40) for a rock drill (41) at its outer end. Two hydraulic cylinders (16, 17) are coupled between the support plate and the boom and located on each side of the boom so that both cylinders are loaded by the weight of the boom, which makes the boom very stable in all positions.

10 Claims, 4 Drawing Figures

DRILL BOOM ARRANGEMENT

BACKGROUND OF THE INVENTION

The invention relates to a drill boom arrangement for positioning an elongated rock drilling apparatus to different drilling positions with respect to a boom support.

In previously known drill boom arrangement of this type it is known to swing the boom laterally by means of a first hydraulic cylinder and vertically by means of a second hydraulic cylinder. A disadvantage with such a construction is that only one of the two hydraulic cylinders is continuously loaded by the weight of the drill boom. This means that air present in the hydraulic system can cause not desired jerky movements of the drill boom.

It is an object of the invention to provide a drill boom arrangement of the above type in which both of the two hydraulic cylinders are continuously loaded by the weight of the drill boom and in which there is required less space at the boom support which is important when the booms are mounted in groups. Another object of the invention is to provide a drill boom arrangement in which each of the two hydraulic cylinders swings the boom both laterally and vertically in order to reduce the weight and volume of the hydraulic arrangement. A further object of the invention is to provide a drill boom arrangement in which two hydraulic cylinders which are pivotally coupled between the drill boom and a boom head carrying the elongated rock drilling apparatus are continuously loaded by the weight of the rock drilling apparatus. A still further object of the invention is to provide a drill boom arrangement in which the projection of the hydraulic cylinders at the boom head is reduced in order to permit the rock drilling apparatus to rotate 360° about an axis which is parallel with its longitudinal axis.

The above and other purposes of the invention will become obvious from the following description and from the accompanying drawings in which one embodiment of the invention is illustrated by way of example. It should be understood that this embodiment is only illustrative of the invention and that various modifications thereof may be made within the scope of the accompanying claims following hereinafter.

DETAILED DESCRIPTION

Figure 1:
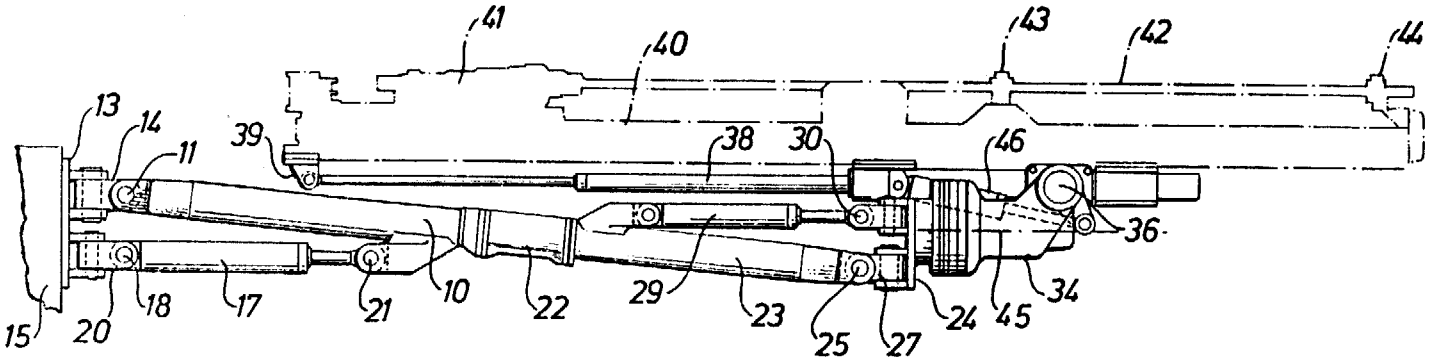
FIG. 1 shows a side view of a drill boom arrangement according to the invention.
Figure 2:
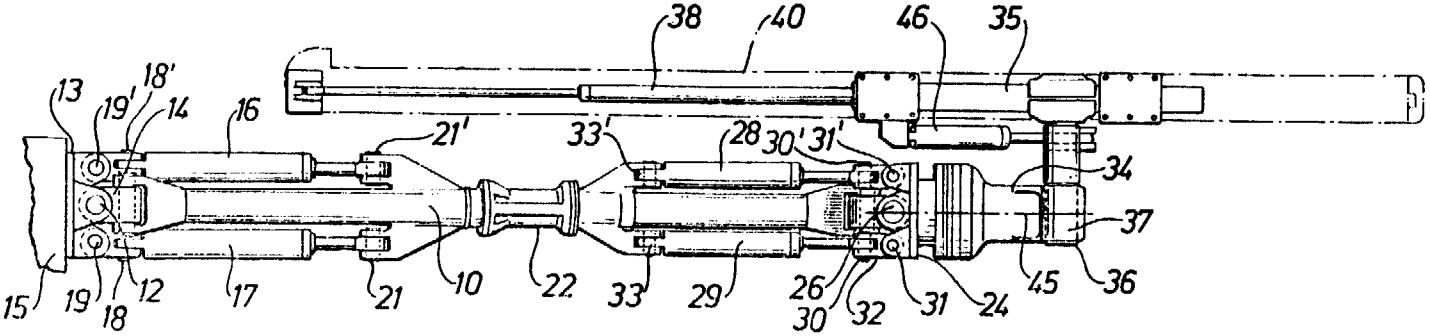
FIG. 2 is a top view of the drill boom arrangement in FIG. 1.

In FIGS. 1 and 2 a boom 10 is pivotally supported on a horizontal cross shaft 11 and a vertical cross shaft 12 which are carried by a boom support or bracket 13. The horizontal cross shaft 11 is journalled in a link 14 which is swingable together with the drill boom 10 about the vertical cross shaft 12. The boom support 13 is carried by an element 15 which forms part of a drill wagon or rig, not shown, on which several drill booms 10 can be mounted in a group. The two cross shafts 11, 12 and the link 14 form a universal joint.

The boom is swingable about the cross shafts 11, 12 by means of hydraulic lift and swing cylinders 16, 17.

The cylinder 17 is pivotable about a horizontal cross shaft 18 and a vertical cross shaft 19 which are carried by the boom support 13. The horizontal cross shaft 18 is journalled in a link 20 which is swingable together with the cylinder 17 about the vertical cross shaft 19. The two cross shafts 17, 19 and the link 20 form a universal joint. The end of the piston rod of the cylinder 17 is pivotally connected to the drill boom 10 by means of a universal joint 21, which comprises a cross shaft with a ball on. The cylinder 16 is connected to the boom support 13 and the boom 10 in the same manner as the cylinder 17. The cross shafts associated with the cylinder 16 are designated 18$^1$, 19$^1$, 21$^1$. The cylinders 16, 17 are of equal size and have the same mounting geometry relative to the boom support 13 and the boom 10.

Due to the fact that the boom support 13 carries the cylinder 17 for swinging about the vertical shaft 19 which is laterally spaced from the vertical swinging plane of the boom 10 a variation in length of solely the cylinder 17 will cause the boom 10 to swing about both the vertical shaft 12 and the horizontal shaft 11.

An extension or contraction of the cylinders 16, 17 of equal amount causes the boom 10 to swing only about the horizontal cross shaft 11. An extension of the cylinder 17 and a contraction of the cylinder 16 of equal amount or vice versa causes the boom 10 to swing about only the vertical cross shaft 12. By differently varying the lengths of the cylinders 16, 17 the boom 10 will simultaneously swing about both cross shafts 11, 12.

The boom 10 carries a guide housing 22 in which an extension member 23 of the boom is guided axially slidably but non-rotatably. The boom extension member 23 is longitudinally extendable by means of a hydraulic cylinder which is mounted inside the boom in a conventional manner. The guide housing 22 and the boom extension member 23 are described in detail in U.S. Pat. No. 3,923,276. The joint 21 is located at a predetermined distance from the cross shaft 12. This distance, thus, is maintained constant during swinging of the boom 10.

The boom extension member 23 carries a boom head 24. The boom head 24 is pivotally supported by the boom extension member on a horizontal shaft 25 and a vertical shaft 26. The horizontal shaft 25 is journalled in a link 27 which is swingable together with the boom extension member about the vertical shaft 26. The link 27 and the shafts 25, 26 form a universal joint.

The boom head 24 is swingable about the cross shafts 25, 26 by means of hydraulic tilt and swing cylinders 28, 29. The end of the piston rod of the cylinder 29 is swingable about a horizontal cross shaft 30 and a vertical cross shaft 31 which are carried by the boom head 24. The horizontal cross shaft 30 is journalled in a link 32 which is swingable together with the cylinder 29 about the vertical cross shaft 31. The shafts 30, 31 and the link 32 form a universal joint. The cylinder 29 is pivotally connected to the boom extension member 23 by means of a universal joint 33 of the same kind as the joint 21. The cylinder 28 is connected to the boom head 24 and the boom extension member 23 in the same manner as the cylinder 29. The cross shafts associated with the cylinder 28 are designated 30$^1$, 31$^1$, 33$^1$. The cylinders 28, 29 are of equal size and have the same mounting geometry relative to the boom head 24 and the boom extension member 23.

Due to the fact that the vertical swinging axis of the cylinder 29 is laterally spaced from the vertical swinging plane of the boom head 24 a variation in length of solely the cylinder 29 will cause the boom head 24 to swing about both the vertical shaft 26 and the horizontal shaft 25.

An extension or contraction of the cylinders 28, 29 of equal amounts causes the boom head 24 to swing only about the horizontal cross shaft 25. An extension of the cylinder 29 and a contraction of the cylinder 28 of equal amount or vice versa causes the boom head 24 to swing only about the vertical cross shaft 26. By differently varying the lengths of the cylinders 28, 29 the boom head 24 will simultaneously swing about both cross shafts 25, 26.

The boom head 24 carries a turning device 34 which can be of the type disclosed in U.S. Pat. No. 3,563,321. Since the construction of the turning device is not essential to the invention it is not described in detail.

A feed beam holder 35 is pivotally journalled in a casing 37 by means of a cross shaft 36. The casing 37 is coupled to the propeller shaft of the turning device 34. The feed beam holder 35 carries an elongated rock drilling apparatus which includes a feed beam 40 supporting a rock drill 41. The feed beam includes hydraulic power means for displacing the drill along the feed beam in a conventional manner. The rock drill 41 rotates a drill steel 42 and delivers longitudinal impacts on the drill steel. The drill steel 42 is guided by means of drill steel centralizers 43, 44. A hydraulic feed extension cylinder 38 for displacing the feed beam 40 is fixed to the feed beam holder 35 and it is also fixed to a bracket 39 which in its turn is fixed in the feed beam 40. The feed beam 40 is slidably supported in the longitudinal direction thereof on the feed beam holder 35 by means of guides fixed thereon. By extension or contraction of the feed beam extension cylinder 38 the position of the feed beam 40 can be adjusted longitudinally with respect to the boom 10.

By actuating the turning device 34, the feed beam 40 can be rotated 360° about an axis 45. Rotation a full revolution is possible due to the fact that the mounting of the boom head 24 at the distal end of the boom extension member 23 is arranged in form of a tripodal frame structure which includes the distal end of the boom extension member and the cylinder 28, 29. This means, that the cylinders 28, 29 will transversely project in a comparatively small extent from the boom 10. The feed beam 40 can be swung by means of a hydraulic cylinder 46 about the cross shaft 36 to a position substantially perpendicular to the polar axis 45 in order to permit transverse drilling, e.g. drilling roof holes.

In order to obtain a hydraulically bound parallel displacement of the feed beam 40 during swinging of the boom 10, the cylinder 16 is hydraulically connected to the cylinder 29 and the cylinder 17 hydraulically connected to the cylinder 28. This hydraulic parallel displacement arrangement is described in detail in Swedish Patent Application No. 7804051-6. This patent application teaches that the requirements which must be met in order to obtain an exact parallel displacement of the feed beam 40 during swinging of the boom 10 are that a triangle having its corners on the horizontal swinging axes 11, 18, 21 is similar to a triangle having its corners on the horizontal swinging axes respectively 25, 30$^1$, 33$^1$ and that a triangle having its corners on the vertical swinging axes 12, 19, 21 is similar to a triangle having its corners on the vertical axes 26, 31$^1$, 33$^1$.

Figure 3:
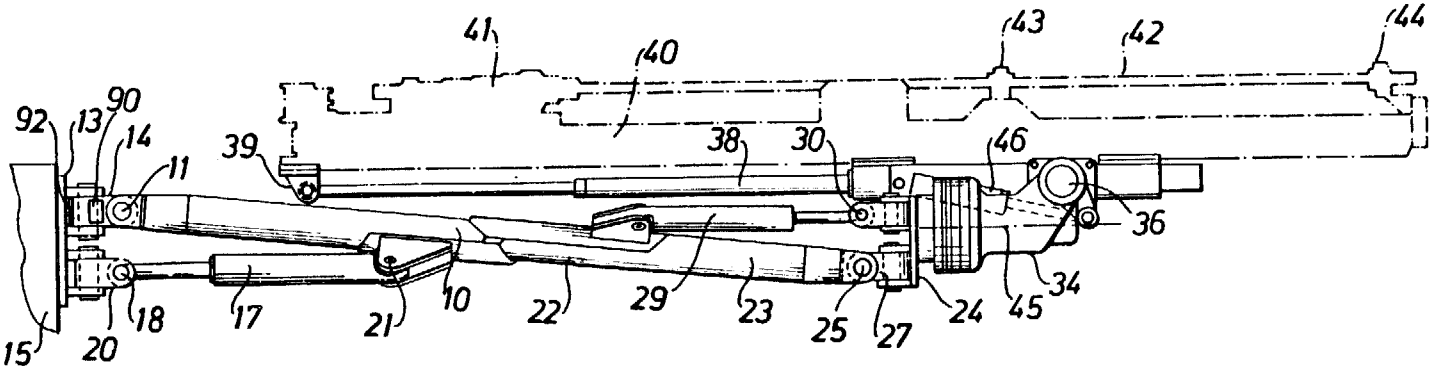
FIGS. 3 and 4 are views corresponding to FIGS. 1 and 2 but showing a somwhat modified drill boom arrangement.
Figure 4:
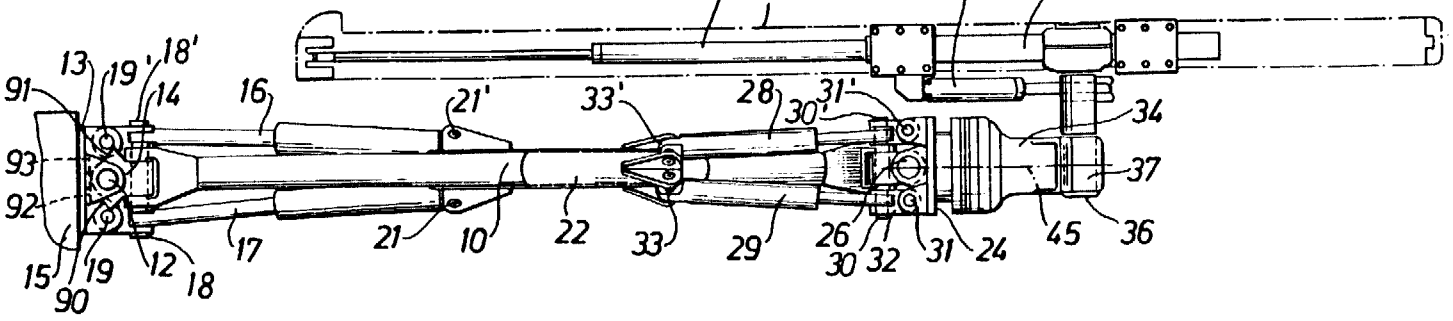

In FIGS. 2 and 3, elements corresponding to elements in the preceding figures have been given the same numerals as in the preceding figures. In the modified embodiment shown in FIGS. 2 and 3, the cylinders 16, 17, and 28, 29 have been turned so that the cylinders are coupled to the four joints 21, 21$^1$, 33, 33$^1$ and the piston rods of the cylinders are coupled to the four horizontal cross shafts 18 and 32. This mounting permits a wider angle of swinging of the boom 10 although the support plate 13 is not bigger. The link 14 has two lugs 90, 91 that will engage two stops 92, 93 on the support plate 13 to limit the horizontal swinging movement of the boom so that the piston rods of the cylinders 16, 17 cannot be forced against the boom 10 and destroyed.

The two shown embodiments are only illustrative of the invention. As examples of possible amendments can be mentioned that all universal joints associated with the boom and the cylinders can be constructed as ball joints. Further, the universal joints between the cylinders 16, 17 and the boom support 13, whether in form of the shown link arrangements or ball joints, can be mounted on lugs which project from the boom support so that these joints are located forwardly of the joint between the boom and the boom support.

We claim:

1. In a drill boom arrangement for positioning an elongated rock drilling apparatus to different drilling positions with respect to a boom support, comprising a boom support (13), a boom (10), a first universal joint (11,12) connecting said drill boom (10) to said boom support (13), first (17) and second (16) hydraulic cylinders coupled to said boom (10) for pivoting said boom in a vertical swinging plane, and second (18, 19) and third (18$^1$, 19$^1$) universal joints connecting respectively said first and second hydraulic cylinders (17, 16) to said boom support (13), the improvement wherein:

said second and third universal joints (18, 19 and 18$^1$, 19$^1$) are located on different sides of the vertical swinging plane of said boom (10) so as to provide means for swinging said boom both laterally and vertically during extension and contraction of solely either one of said first and second hydraulic cylinders.

2. A drill boom arrangement according to claim 1 comprising fourth (21) and fifth (21$^1$) universal joints connecting said first and second hydraulic cylinders (17, 16) to said drill boom and which are disposed at a predetermined distance from said first universal joint (11, 12), said predetermined distance being maintained constant during swinging of said boom.

3. A drill boom arrangement according to claim 2 in which said predetermined distance is less than half the length of the boom.

4. A drill boom arrangement according to claim 2 or 3 in which the distance between the first (11, 12), second (18, 19) and third (18$^1$, 19$^1$) universal joints are less than one third of said distance from said first universal joint (11, 12) to said fourth and fifth universal joints (21, 21$^1$).

5. A drill boom arrangement according to claim 1 or 2 further comprising a boom head (24) universally pivotably mounted on the distal end of said boom (10), said boom head carrying said elongated rock drilling apparatus (40, 41), third (28) and fourth (29) hydraulic cylinders for pivoting said boom head, and sixth (30$^1$, 31$^1$) and seventh (30, 31) universal joints for connecting respectively said third and fourth hydraulic cylinders to said boom head, said sixth and seventh universal joints being located on different sides of a central vertical plane through said boom.

6. A drill boom arrangement according to claim 1 in which said first and second hydraulic cylinders (16, 17) are coupled to said fourth and fifth universal joints (21, $21^1$) and have their piston rods coupled to said second and third universal joints (18, 19 and $18^1$, $19^1$).

7. A drill boom arrangement according to claim 1 in which said first and second hydraulic cylinders (17, 16) are of equal size and have the same mounting geometry relative to the boom (10) and the boom support (13).

8. A drill boom arrangement according to claim 7 in which said third and fourth hydraulic cylinders (28, 29) are of equal size and have the same mounting geometry relative to the boom (10) and the boom head (24).

9. A drill boom arrangement according to claim 1 or 6 comprising a common support plate (13) on which said first, second and third universal joints (11, 12; 18, 19; and $18^1$, $19^1$ respectively) are mounted, and means (92, 93) provided on said common support plate for limiting the horizontal movement of said boom (10).

10. A drill boom arrangement according to claim 2 or 3 in which the distances between the first (11, 12), second (18, 19) and third ($18^1$, $19^1$) universal joints are less than one fourth of said distance from said first universal joint (11, 12) to said fourth and fifth universal joints (21, $21^1$).

* * * * *